US007537066B1

(12) United States Patent
Flud et al.

(10) Patent No.: US 7,537,066 B1
(45) Date of Patent: May 26, 2009

(54) AUTOMATIC DRILLER

(75) Inventors: Sammy Kent Flud, Brownwood, TX (US); Andrew Weddle, Gardendale, TX (US)

(73) Assignee: Eagle Rock Manufacturing, LLC, Midland, TX (US)

( * ) Notice: Subject to any disclaimer, the term of this patent is extended or adjusted under 35 U.S.C. 154(b) by 191 days.

(21) Appl. No.: 11/748,271

(22) Filed: May 14, 2007

(51) Int. Cl.
*E21B 44/02* (2006.01)

(52) U.S. Cl. ..... 175/27; 175/122

(58) Field of Classification Search ..... 175/27, 175/122
See application file for complete search history.

(56) References Cited

U.S. PATENT DOCUMENTS 2,100,131 A * 11/1937 Capeliushnicoff et al. .. 303/6.01
3,373,823 A * 3/1968 Benner et al. ..... 173/6
4,662,608 A * 5/1987 Ball ..... 254/273
4,865,393 A * 9/1989 Falcon ..... 303/15
4,896,377 A * 1/1990 Ferdi ..... 2/115
5,474,142 A * 12/1995 Bowden ..... 175/27
7,044,239 B2 * 5/2006 Pinckard et al. ..... 175/57
2003/0234119 A1 * 12/2003 Ray ..... 175/27
2004/0226748 A1 * 11/2004 Prior et al. ..... 175/27

* cited by examiner

*Primary Examiner*—Hoang Dang
(74) *Attorney, Agent, or Firm*—Buskop Law Group, PC; Wendy Buskop

(57) ABSTRACT

An automatic driller for controlling a rotating primary mover. The automatic driller has a manual brake handle. The manual brake handle has a stroke. A first elastic means applies a first tension to the manual brake handle. A swivel bracket is connected to the first elastic means. The first elastic means provides a first tension onto the swivel bracket.

15 Claims, 5 Drawing Sheets

AUTOMATIC DRILLER

FIELD

The invention relates to an automatic driller to control a drum during drilling operations, such as drilling an oil well or water well.

BACKGROUND

There exists a need for an automatic driller that can accurately and efficiently control a drum. For accurate control of a rotating primary mover, which can be connected to a top drive, there exists a need for a automatic driller that repeatably returns a manual brake handle to a set position within the effective stroke for controlling the movement of the rotating primary mover, which can be connected to various pieces of drilling equipment.

The present invention meets these needs.

DETAILED DESCRIPTION OF THE EMBODIMENTS

Figure 1:
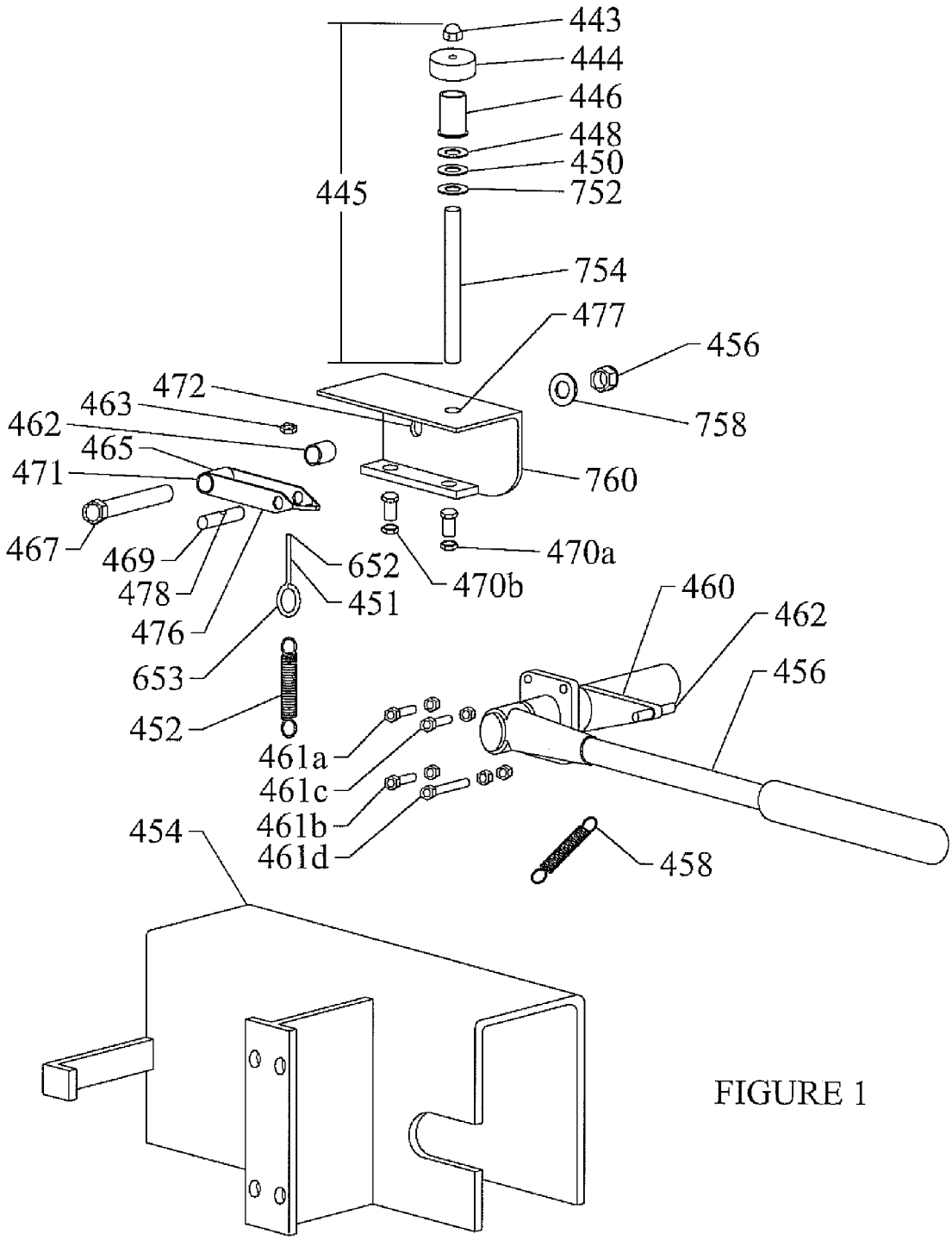
FIG. 1 depicts an exploded view of an embodiment of the automatic driller.

The invention will be described with reference to the drawings, the detailed description, and the claims.

The automatic driller regulates the position of the manual brake handle, forcing the manual brake handle to return to a set point within the effective stroke of the manual brake handle. The effective stroke of the manual brake handle is where the manual brake handle is activating the braking system enough to create a friction force on a rotating primary mover. The rotating primary mover can be a drawworks drum adapted to move a traveling frame assembly. The automatic driller has a first elastic means, such as a coil spring, a spring clip, or an elastic band.

A swivel bracket connects to the first elastic means. The first elastic means provides a first tension to the manual brake handle. The swivel bracket has a pivot point located where the manual brake handle engages the swivel bracket.

A second elastic means, such as a coil spring, is used for applying a counter tension to the manual brake handle. The counter tension is adjusted to provide an equalizing force to the force produced by the first tension at a set point. The set point can be within the effective stroke. The effective stroke can range from 0.5 to 8 inches. The set point can be adjusted for a desired movement and a selected load weight.

An extension rod with a first end and a second end engages the second elastic means at the first end. The second elastic means can be axially aligned with the extension rod. The extension rod can be an eyebolt, wherein the eye engages the second elastic means or a steel cylinder adapted at one end for receiving the second elastic means. A fulcrum assembly can be connected to the second end of the extension rod.

An adjustment stem assembly can be connected to the fulcrum assembly. The adjustment stem assembly can be adapted to adjust the fulcrum assembly by increasing or decreasing the counter tension in the second elastic means.

The counter tension maintains the manual brake handle at a set point. The manual brake handle can be moved from the set point by the application of an independent outside force. The counter tension can return the manual brake handle to the set point when the independent outside force is removed. The effective stroke is proportional to a rotational velocity of a rotating primary mover, which can be a drawworks drum on a drilling rig. The effective stroke causes the rotating primary mover to increase, decrease, or stop motion of the rotating primary mover and the associated piece of drilling equipment.

The adjustment stem assembly can be made up of a threaded rod disposed through a first bearing race. A needle thrust bearing is disposed on the first bearing race. A second bearing race is disposed on the needle thrust bearing, and a spacer sleeve is disposed on the second bearing race. An adjustment knob is disposed on the spacer sleeve, and the threaded rod connects to an adjustment pin on the fulcrum assembly. The adjustment knob can adjust the fulcrum assembly.

A first housing can be used to contain the manual brake handle. In an embodiment, the manual brake housing can be made of steel. The manual brake housing provides support for the first elastic means.

The automatic driller can be used on a drilling rig control panel for controlling a drawworks drum.

In an embodiment of the invention the automatic driller can be connected to a pneumatic braking means, such as air caliper brakes. The pneumatic braking means can be connected to the rotating primary mover.

In an embodiment of the pneumatic braking means, the operator manually actuates the pneumatic braking means by using the manual brake handle. The pneumatic braking means can be used when the rotating prime mover, such as a drawworks, is in any running state.

The second elastic means can be configured to bring back the manual brake handle to a set point once the pressure manually supplied by the operator is removed from the manual brake handle.

The embodiments of the invention can be better understood with reference to the figures.

Figure 2:
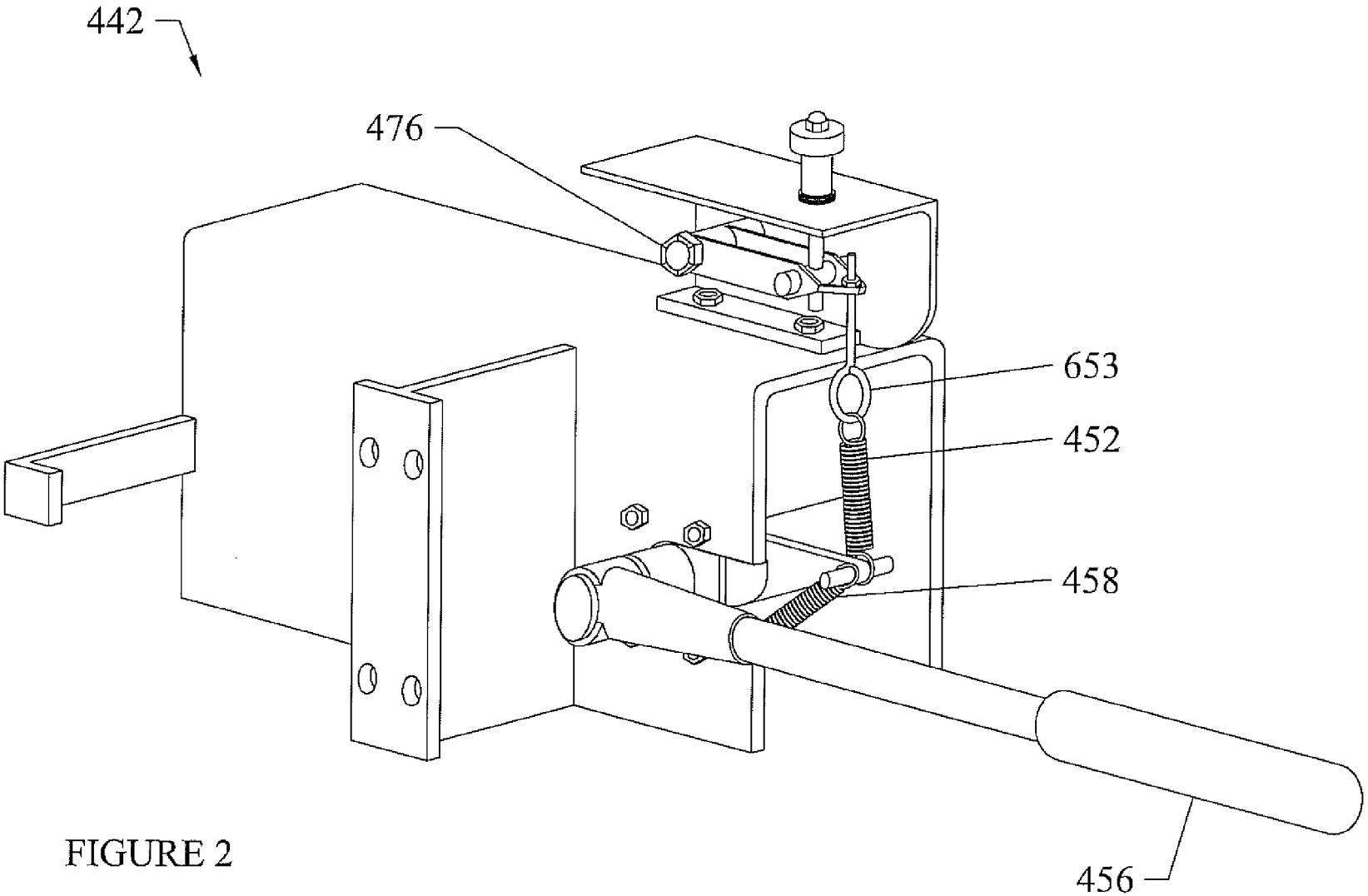
FIG. 2 depicts an assembled view of an embodiment of the automatic driller.
Figure 5:
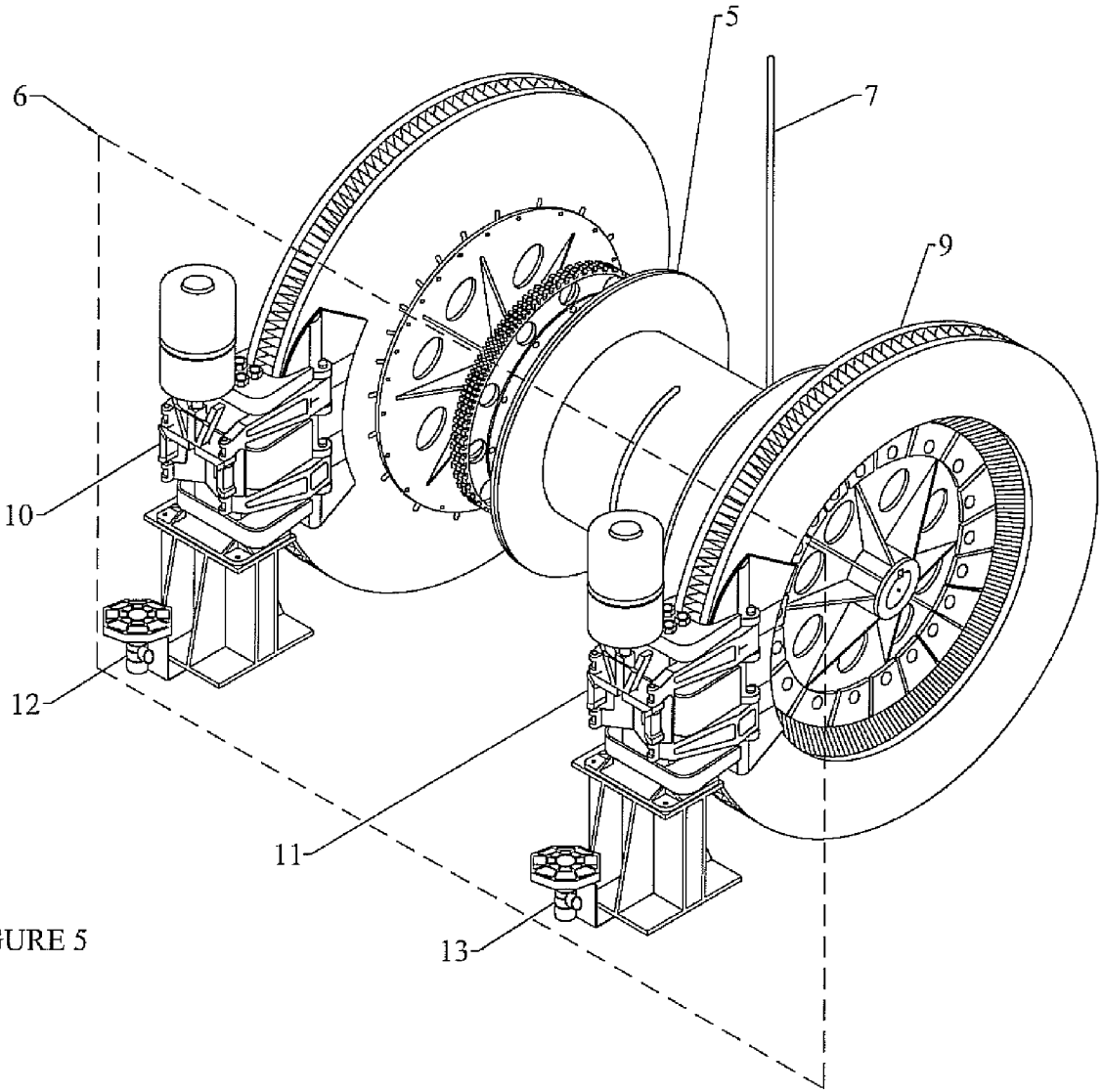
FIG. 5 depicts a rotating primary mover with a braking system acted on by the automatic driller.

With reference to the FIG. 1 and FIG. 2, an exploded view of an embodiment of the automatic driller 442, is depicted in FIG. 1 and an assembled view of the automatic driller 442 is depicted in FIG. 2. A manual brake handle 456 is connected to a braking system, which is shown in FIG. 5, and a first housing 454. The first housing 454 can be made from steel, and have a width of about 5 inches, a height of about 7.5 inches, and a thickness of about 0.25 inches.

Four thread fasteners 461*a*, 461*b*, 461*c*, and 461*d*, such as bolts with a length of about 1 inch, are used to attach the manual brake handle 456 to the first housing 454.

A first elastic means 458, such as a coil spring, is attached to a receiving pin 462, such as a steel rod having a diameter of about ¼ inch and a length of about 2 inches, which is secured to swivel bracket 460. The first elastic means 458 is secured to the first housing 454. The receiving pin 462 extends through swivel bracket 460, for securing the first elastic means 458 and a second elastic means 452 to the manual brake handle.

Figure 3:
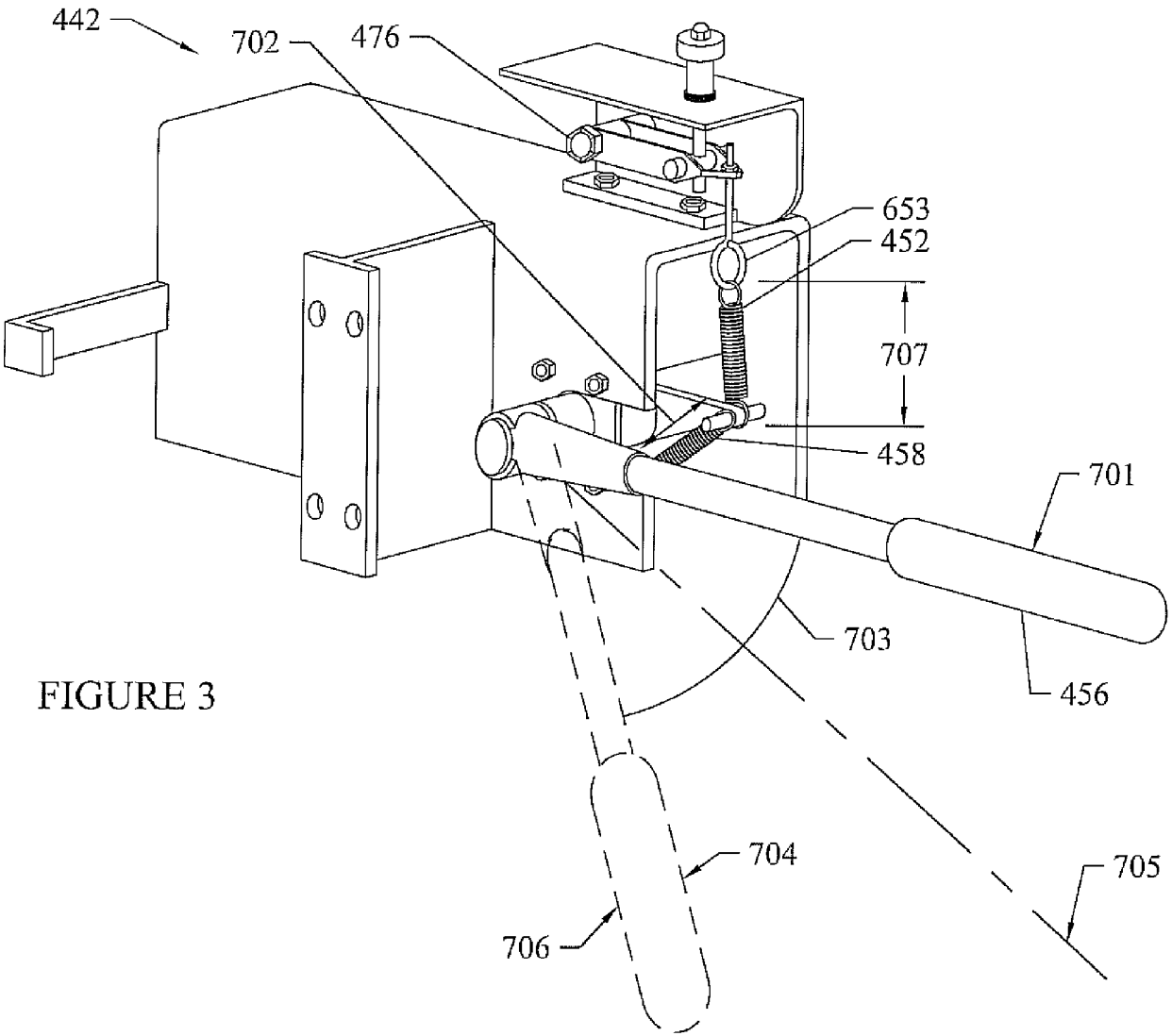
FIG. 3 depicts an embodiment of the automatic driller in a first position and a fully displaced position.

FIG. 3 shows the movements of the manual brake handle 456 from a set point 705 to a fully displaced position 706. The manual brake handle 456 has a first tension 702 created by the first elastic means 458, which draws the manual brake handle 456 down, and a counter tension 707, created by the second elastic means 452, that draws the manual brake handle 456 up.

The set point 705 is controlled by the counter tension 707. The set point 705 is where the first tension 702 and the counter tension 707 are in equilibrium. The manual brake handle 456 is shown to have a fully displaced position 706.

The manual brake handle 456 can be moved to the fully displaced position 706 when an independent outside force 704 is applied to the manual brake handle 456, overriding the counter tension 703.

The independent outside force 704 can be an operator applying the force. The manual brake handle 456 has a effective stroke 703 between the first position 701, which is when the manual brake handle is just starting to activate the braking system, and the fully displaced position 706. When the manual brake handle 456 is in the fully displaced position 706 the braking system is fully activated. The effective stroke 703 can range from approximately 0.5 inches to approximately 8 inches. The set point 705 is within the effective stroke 703.

The effective stroke 703 is proportional to a rotational velocity of a rotating primary mover connected to a piece of drilling equipment. The effective stroke 703 causes the rotating primary mover to increase, decrease, or stop the motion of a piece of drilling equipment.

The counter tension 707 repeatably returns the manual brake handle 456 to the set point 705 when the independently applied outside force 704 is removed.

Returning to FIG. 1, the second elastic means 452, such as a coil spring, connects to an extension rod 451, which is connected to a fulcrum assembly 476. The extension rod 451 has a first end 653 and a second end 652. The first end 653 connects to the second elastic means 452. The second elastic means 452 is connected to the swivel bracket 460, such that the second elastic means is substantial perpendicular to the swivel bracket 460. The second elastic means 452 is axially aligned with the extension rod 451. The extension rod 451 can be an eyebolt, or a steel cylinder adapted at one end for receiving the second elastic means.

In the fulcrum assembly 476 a fulcrum lever 465 is secured to a bracket 760, which can be made out of steel and has a height of about 3 inches, a width of about 3 inches, and a thickness of about 3/16 of an inch.

The fulcrum lever 465 is secured to a top of the first housing 454 by the use of two threaded fasteners 470*a* and 470*b*, which have a length of about 1 inch. The fulcrum lever 465 is secured to the bracket 760 by the use of a pivot pin 467, such as cap screw.

The pivot pin 467 is inserted through a through hole 471, which has an inner diameter of about 500/1000 of an inch, located at an end of the fulcrum lever 465. The fulcrum spacer sleeve 462 is disposed on the pivot pin 467 before it is inserted into the through hole 471 and is disposed on the outside of the fulcrum lever 465. The spacer sleeve 462 can be a metal collar with a 500/1000 of an inch center hole. The spacer sleeve 462 is used to control the space between the bracket 760 and the fulcrum lever 465.

A lock nut 463 is used to fasten the pivot pin 467 to the fulcrum lever 465. The pivot pin 467 extends into a first extrusion 472 in the bracket 760 and is fixed to the bracket 760 by the use of an assembly of a nut 456 and a washer 758. An adjusting pin 469 is disposed through the fulcrum lever 465.

An adjustment stem assembly 455, is connected to the fulcrum assembly 476. The adjustment stem assembly 454, includes a threaded rod 754 having a diameter of about 5/16 of an inch, and is disposed through a third extrusion 477 in the top of the bracket 760. The threaded rod 754 inserts into a threaded central hole 478 disposed in the adjusting pin 469. A first bearing race 752 is disposed on the threaded rod 754 and rests on the top of the bracket 760. A needle thrust bearing 450 is disposed on the first bearing race 752.

A second bearing race 448, which is substantially similar to the first bearing race 752, is disposed on the threaded rod 754 and rests upon the first bearing race 752. A spacer sleeve 446, such as a metal collar having a 5/16 center hole, and an outside diameter of about 3/4 of an inch, is disposed on the threaded rod 754 and rests upon the second bearing race 448.

An adjustment knob 444, such as a metal knob with a threaded center having an inside diameter of about 5/16 of an inch, is disposed on the threaded rod 754 and rests upon the spacer sleeve 446. A second nut 443, such as an acorn lock nut with a 5/16 threaded center hole, is disposed on the threaded rod 754 and is used to fix the adjustment knob 444 to the threaded rod 754. The spacer sleeve 446, the first bearing race 752, and the second bearing race 448 rest on top of the bracket 760 and are aligned by the force created by the second elastic means 452. The adjusting pin 469 connects the threaded rod 754 to the fulcrum assembly 476.

The adjustment knob 444 adjusts the fulcrum assembly 476, which in return adjusts the counter tension 707 shown in FIG. 3. For example when the adjustment knob 444 is turned clockwise it causes the adjusting pin 469 to move the fulcrum lever 465, which extends the second elastic means 452 producing a greater counter tension 707. When the adjustment knob 444 is turned counterclockwise, it causes the adjusting pin 469 to lower the fulcrum lever 465, which decreases the counter tension 707.

Figure 4:
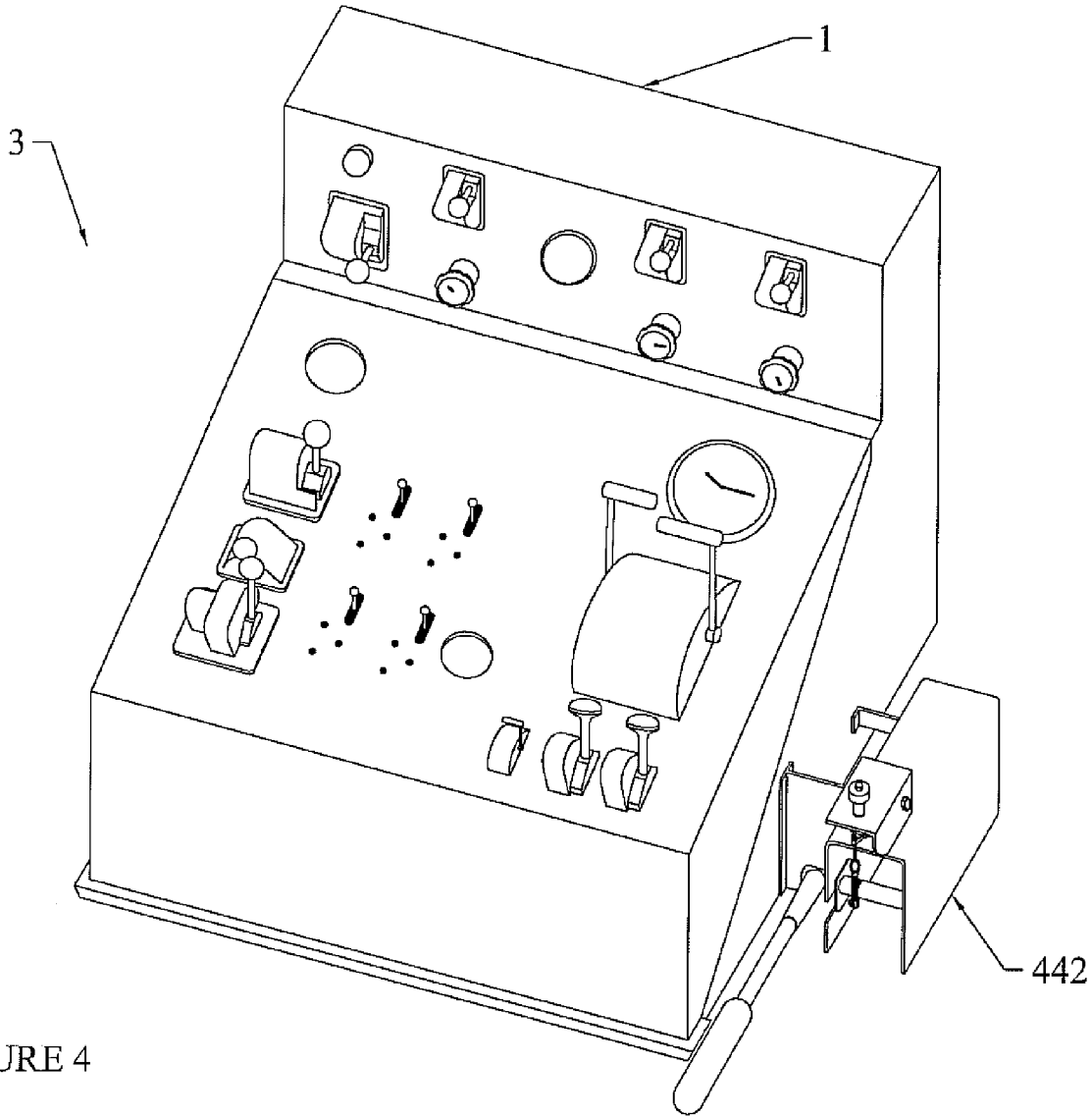
FIG. 4 depicts an embodiment of an assembled automatic driller secured to a control panel, which can be used during drilling operations.

FIG. 4 depicts an embodiment of an automatic driller 442 secured to a control panel 1, which can be in communication with a drilling rig for controlling a rotating primary mover as depicted in FIG. 5. The control panel 1 can have a plurality of controls. For example, the control panel 1 can have a power throttle for a top drive, a hydraulic lever for operating a hydraulic system, a emergency all stop, or a forward and reverse control for a top drive.

FIG. 5 depicts an embodiment of the rotating primary mover 5 and braking system 6 controlled by the automatic driller 442. The primary mover 5, which can be a draworks drum, operates a fast line 7, which can be wire rope or steel cable with a diameter ranging from 1-inch to 1⅛ inches. An example of a fast line is Flex-X-9™ available from Wire Rope Corporation of America of Missouri.

The rotating primary mover 5, such as a drawworks drum, has a caliper disk 9 which is adapted to be engaged by a first and second caliper brake 10 and 11. An example of the brakes can be obtained from Kobelt, of Vancouver, Canada. The first caliper brake 10 and second caliper brake 11 can have a first and second pressure compensated relay valve 12 and 13.

The first caliper brake 10 and second caliper brake 11 can be operated with an air operating system. The air operating system can be connected to a pneumatic system, such as a compressed air tank with a psi between 90 and 100 pounds per square inch. The caliper brake reduces most of the force needed to operate a manual brake handle because the air operated valves only require minimum effort to operate the caliper brakes. The caliper brakes eliminate the need to adjust the brake bands or any linkages.

When the manual brake handle 456 is fully displaced, the braking system will be activated and the fast line 7 will not be allowed to move. When external pressure is removed from the manual brake handle, the manual brake handle will move to the set point 705.

When the manual brake handle 456 reaches the set point 705 the primary mover will rotate with a set rotational speed corresponding to the set point 705, such as 30 radians/second. The set rotational speed of the primary mover 5 will control the axial speed of the fast line 7. The set point can be selected for a desired movement and a selected load weight. For example, the set point can be adjusted such that a piece of drilling equipment weighing 1,000 pounds has an axial speed of 20 ft/minute.

The fast line 7 can be attached to a piece of moveable drilling equipment such as a top drive. By controlling the axial speed of the fast line, the speed of the connected pieces of drilling equipment will be controlled.

The invention is extremely useful when precision movement of a piece of equipment is required. The automatic driller prevents accidents by automatically controlling the speed of a piece of moveable drilling equipment. This reduces accidents associated with user error.

While these embodiments have been described with emphasis on the embodiments, it can be understood that within the scope of the appended claims, the embodiments might be practiced other than as specifically described herein.

What is claimed is:

1. A automatic driller for controlling a rotating primary mover wherein the automatic driller comprises:

a. a first housing;

b. a manual brake handle comprising a stroke;

c. a swivel bracket connected to the manual brake handle;

d. a first elastic means engaging the first housing and the swivel bracket; wherein the first elastic means applies a first tension to the manual brake handle;

e. a second elastic means engaging the swivel bracket for applying a counter tension to the manual brake handle;

f. an extension rod comprising a first end and a second end, wherein the first end is connected to the second elastic means;

g. a fulcrum assembly connected to the second end of the extension rod;

h. an adjustment stem assembly is connected to the fulcrum assembly, wherein the adjustment stem is adapted to adjust the fulcrum assembly by increasing or decreasing the counter tension in the second elastic means, forming a set point within an effective stroke of the manual brake handle;

i. wherein the counter tension maintains the manual brake handle at the set point; and j. wherein the effective stroke is proportional to a rotational velocity of a rotating primary mover connected to a piece of drilling equipment, and wherein the effective stroke causes the rotating primary mover to increase, decrease, or stop the motion of a piece of drilling equipment.

2. The automatic driller of claim 1, wherein an independently applied outside force overrides the counter tension to fully displace the manual brake handle.

3. The automatic driller of claim 2, wherein the counter tension repeatably returns the manual brake handle to the set point when the independently applied outside force is removed.

4. The automatic driller of claim 1, wherein the effective stroke has a range between 0.5 to 8 inches.

5. The automatic driller of claim 1, wherein the first elastic means is a coil spring.

6. The automatic driller of claim 1, wherein the swivel bracket is disposed at a pivot point for the manual brake handle.

7. The automatic driller of claim 1, wherein the counter tension and the first tension are in equilibrium at the set point.

8. The automatic driller of claim 1, wherein the set point is selected for a desired movement and a selected load weight.

9. The automatic driller of claim 1, wherein the second elastic means comprises a coil spring.

10. The automatic driller of claim 1, wherein the second elastic means is substantially perpendicular to the swivel bracket.

11. The automatic driller of claim 1, wherein the second elastic means is axially aligned with the extension rod.

12. The automatic driller of claim 1, wherein the extension rod comprises an eyebolt, or a steel cylinder adapted at one end for receiving the second elastic means.

13. The automatic driller of claim 1, wherein the adjustment stem assembly comprises: a threaded rod disposed through a first bearing race, a needle thrust bearing disposed on the first bearing race, a second bearing race disposed on the needle thrust bearing, a spacer sleeve disposed on the second bearing race, and a adjustment knob disposed on the spacer sleeve, wherein the threaded rod connects to an adjusting pin on the fulcrum assembly, and wherein the adjustment knob adjusts the fulcrum assembly.

14. The automatic driller of claim 1, wherein the manual brake handle is secured to the first housing.

15. The automatic driller of claim 1, wherein the first housing comprises steel.

* * * * *